United States Patent [19]

Kotkins, Jr.

[11] Patent Number: 4,472,870

[45] Date of Patent: Sep. 25, 1984

[54] METHOD OF MANUFACTURING SUITCASE

[75] Inventor: Henry L. Kotkins, Jr., Seattle, Wash.

[73] Assignee: Skyway Luggage Company, Seattle, Wash.

[21] Appl. No.: 318,994

[22] Filed: Nov. 6, 1981

Related U.S. Application Data

[62] Division of Ser. No. 201,519, Oct. 27, 1980, abandoned.

[51] Int. Cl.[3] ..... B23P 9/00

[52] U.S. Cl. ..... 29/445; 29/515; 190/119; 190/122

[58] Field of Search ..... 29/445, 515, 434; 190/41 Z, 41 R, 49

[56] References Cited

U.S. PATENT DOCUMENTS

| | | | |
|---|---|---|---|
| 2,716,473 | 8/1955 | Droutman | 190/41 Z X |
| 3,165,827 | 1/1965 | Stollman | 29/445 |
| 3,291,267 | 12/1966 | Pelavin | 190/49 |
| 3,447,649 | 6/1969 | Kish, Jr. | 190/41 R X |
| 3,477,553 | 11/1969 | Kish, Jr. | 190/41 Z |
| 3,579,804 | 5/1971 | Slan | 29/445 X |
| 3,737,980 | 6/1973 | Katkins | 29/445 X |

FOREIGN PATENT DOCUMENTS

| | | | |
|---|---|---|---|
| 766735 | 7/1934 | France | 190/41 Z |

*Primary Examiner*—Charlie T. Moon

*Attorney, Agent, or Firm*—Seed and Berry

[57] ABSTRACT

A soft soft-sided luggage case preferably comprises a frame and a pair of hinged side panels which are zippered to fabric portions of the frame around the periphery and which provide unobstructed access to the interior of the case. Abutting portions of the frame and the side panels provide a seal when the side panels are zippered closed. The fabric portion of the frame is frictionally held between two pairs of outwardly facing flanges.

4 Claims, 6 Drawing Figures

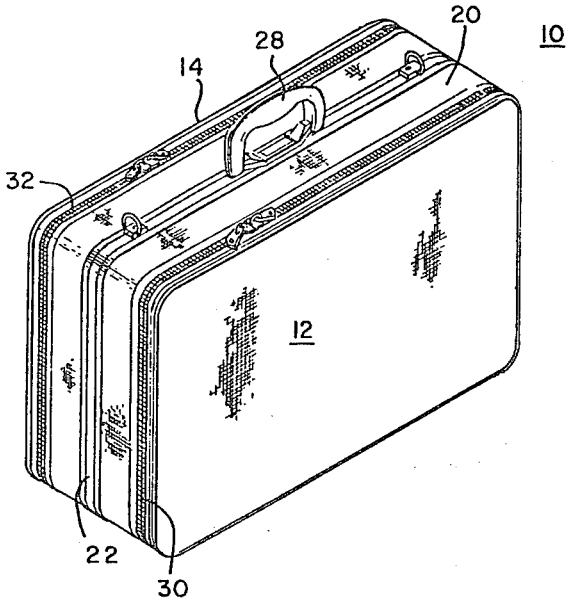
FIG. 1
FIG. 2
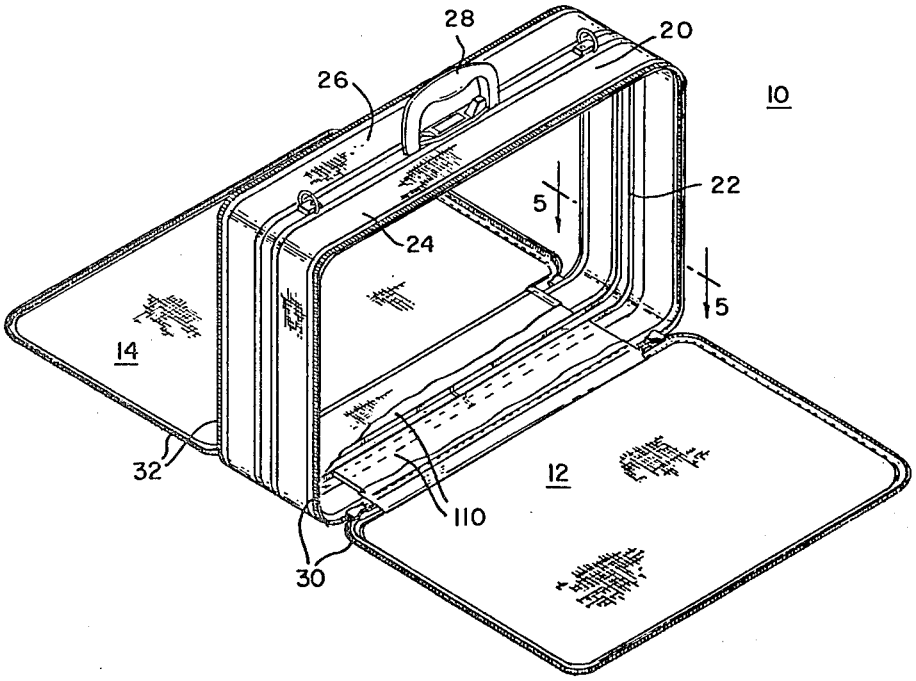

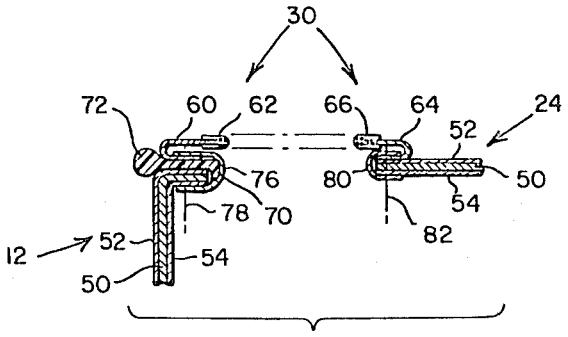
FIG. 3
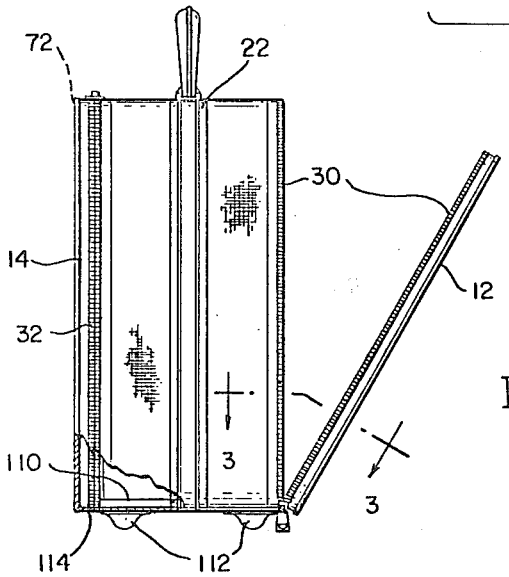
FIG. 4
FIG. 5
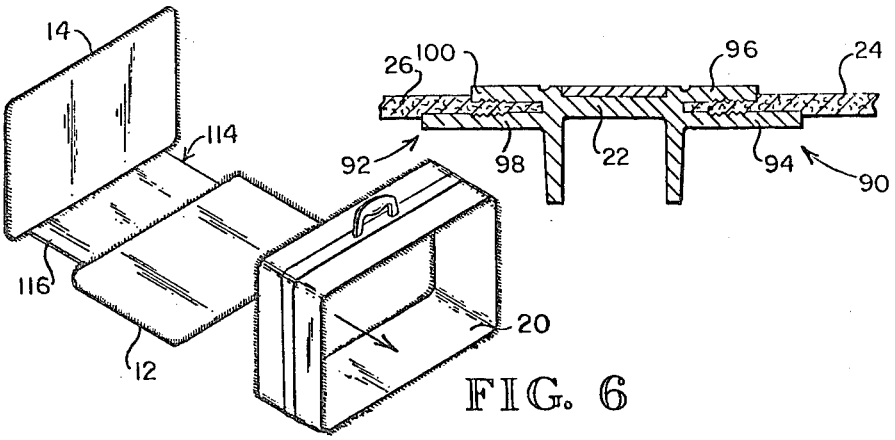
FIG. 6

METHOD OF MANUFACTURING SUITCASE

This application is a division of U.S. Pat. application Ser. No. 201,159, filed Oct. 27, 1980, now abandoned.

FIELD OF THE INVENTION

This invention preferably relates to luggage cases which have unobstructed interior access, and to methods to manufacture these cases.

BACKGROUND OF THE INVENTION

Soft-sided luggage cases use two fabric side panels to provide a lightweight yet strong enclosure. For example, a soft-sided luggage case, disclosed in U.S. Pat. No. 3,185,271, has a flexible access flap included within one side panel. The edges of the access flap are located at a distance from the panel edge, leaving a lip on the side panel which partially obstructs access to the interior of the case. Another luggage case, disclosed in U.S. Pat. No. Re. 26,443, has a rigid center frame portion and soft-sided panels mounted to the frame on opposite sides. One of the soft-sided panels has a U-shaped access flap which also forms a lip that partially obstructs access to the interior of the case. A third luggage case, disclosed in U.S. Pat. No. 3,737,980, has interlocked metal frame sections. The frame sections have outwardly facing flanges which hold fabric panels. To obtain access to the interior of the case, the frame sections split, so that the case opens in two halves like the common suitcase.

SUMMARY OF THE INVENTION

This invention relates to a lighweight, soft-sided suitcase which provides unobstructed access to the interior of the case. Preferably, both side panels open around at least three adjacent sides of the frame's periphery to allow access. Preferably, zippers join the side panels to the frame. When unzipped along the top and sides, the side panels can flop back to leave the sides fully open.

A preferred luggage case includes a frame and two side panels joined pivotally mounted along opposing edges of the frame to provide access to the interior of the case. Preferably, a zipper provides a hinged joining for the frame and each side panel, although other means for hingedly joining may be used for one edge. One half of the zipper is attached to the outside edge of the frame. The other half of the zipper is secured to the side panel. When a side panel is unzipped, unobstructed access to the interior of the suitcase is provided along the entire side of the frame. Sealing between the frame and the side panels is provided by binding strips which interfit and overlap when the zipper is closed. Protective beads preferably are provided on the edges of the case. The frame preferably includes two oppositely extending pairs of integral, outwardly facing flanges which hold the fabric portions of the frame by friction clamping, as taught in U.S. Pat. No. 3,737,980.

A preferred method of making a luggage case of this invention comprises the steps of (1) forming a frame defining the interior volume of the case, (2) forming a second piece, which includes two portions, each of which is shaped for covering substantially the periphery of one side of the frame, and a third portion, which connects the two shaped portions and which extends across the bottom of the frame when the parts forming the suitcase are assembled, and (3) connecting the second piece to the frame. Zippers preferably are fastened along the margins of the frame and the shaped portions of the second piece to connect the frame and second piece together. In one embodiment of the invention, the frame is formed by cutting a central support member having two pairs of integral, spaced, outwardly facing flanges to a length determined by the size of the case to be manufactured, and the fabric portions are placed between the flanges, which are squeezed together to frictionally hold the fabric portions between the flanges. One-half of a zipper is attached to each margin of the fabric portions. The frame is then bent into a desired configuration and the side panels are attached by means of the other half of the zipper to complete the suitcase.

BRIEF DESCRIPTION OF THE DRAWINGS

FIG. 1 is a perspective view of a preferred suitcase when it is closed.

FIG. 2 is a perspective view, partially cut away, of a preferred suitcase when it is open.

FIG. 3 is a sectional view of a portion of a preferred suitcase, taken along line 3—3 of FIG. 4, showing abutting edges beneath the zipper closure.

FIG. 4 is an end elevation view, partially cut away, of a preferred suitcase, showing how a side panel may pivot.

FIG. 5 is a sectional view of a portion of the frame taken along line 5—5 of FIG. 2.

FIG. 6 is a schematic showing the preferred construction of a suitcase prior to joining the sides and frame.

DETAILED DESCRIPTION OF A PREFERRED EMBODIMENT

A preferred suitcase 10 of this invention includes a frame portion 20 which defines the interior volume of the case (as shown in FIG. 2). The frame 20 preferably includes a metal support member 22 (shown in cross-section in FIG. 5) which is bent in a rectangular shape. The edges of the soft sections 24 and 26 of the frame 20 preferably are fabric and are frictionally held between flanged portions of the support member 22, as described below. A carrying handle 28 is preferably fastened to the support member 22. The panels 12 and 14 are attached to the frame 20 by zippers 30 and 32. The zippers are preferably positioned along the entire periphery of the frame 10 to provide unobstructed access to the interior of the suitcase when unzipped on three adjacent sides of a panel.

FIG. 3 shows the preferred way of fastening the zipper assembly 30 to the side panel 12 and to the fabric portion 24 of the frame 20. The panel 12 includes a relatively thick backing 50, which is preferably rubberized. The exterior surface of the backing 50 is covered with a decorative, wear-resistant fabric 52. The interior surface is preferably covered with a smooth lining fabric 54. The fabric portions 24 and 26 of the frame also include a backing 50, a decorative, wear-resistant exterior covering 52, and an interior liner 54. The zipper assembly 30 includes a first zipper half having a fabric strip 60 and teeth 62 spaced along the free edge of the fabric strip 60. The other half of the zipper assembly 30 also includes a fabric strip 64 and its associated teeth 66. The fabric strip 60 of the zipper is sewn to the margin of the panel 12 along with a plastic reinforcing strip 70 (along line 78, as indicated in FIG. 3). The fabric strip 64 of the zipper assembly 30 for the frame is sewn to the margin of the fabric assembly 24 (along line 82), with the edge of the fabric and the zipper fabric strip 64 being covered by a plastic binding strip 80. When zipped together, the binding strips 76 and 80 abut to provide a seal for the interior of the suitcase. Also, when zipped, the bead 72 forms a protective edge around the suitcase 10.

As shown in FIGS. 2 and 5, a metal, extruded support member 22 is bent to form the frame 20. The fabric portions 24 and 26 are preferably held by friction between two pairs of oppositely extending flanges 90 and 92, which have internally serrated, outwardly extending flange positions 94, 96, 98 and 100. The lightweight metal support member 22, such as aluminum, is positioned around the middle of the suitcase 10. As shown in FIG. 2, the ends of the support member 22 are held substantially in abutment by a pair of plywood strips 110, which also reinforce the bottom. The ends need not abut, but the space between the ends preferably is as small as conveniently possible. A plurality of bumper legs 112 or wheels (not shown) are riveted to the strips and frame along the bottom.

A preferred method of making a suitcase 10 of this invention comprises the steps of (1) forming the frame 20, (2) forming a second piece 114, which includes two side portions 12 and 14, each of which is shaped for covering substantially the periphery of one side of the frame, and a third portion 116, which connects the two shaped side portions 12 and 14, and which extends across the bottom of the frame when the suitcase is assembled, and (3) connecting the second piece 114 to the frame 20. Mating zippers fastened along the margins of the frame and along the shaped portions of the second piece connect the two pieces together. A zippered connection allows the shaped portions (side panels 12 and 14 when attached) to open and to hinge about the bottom. The side panels 12 and 14 cover substantially all of their respective sides of the case 10. Each provides unobstructed access to the interior of the case when open. Preferably, the zippers are fastened along the entire margins of the frame 20 and of the side panels 12 and 14. Zippering along three adjacent sides may also be used, but the complete zippering is greatly preferred.

In forming the suitcase 10, an aluminum support member 22 is cut so that its length substantially equals the periphery of the suitcase 10. Fabric portions 24 and 26 are inserted and secured between the flanges 90 and 92 of the support member 22. One half of a zipper 64 is sewn along the exposed edge of a fabric portion 24 or 26. Preferably, a binding strip 80 covers the overlapped portion of the zipper 64 and fabric portion 24. The support member 22, fabric portions 24 and 26, and zippers 64 are then bent into the desired shape. A rectangular shape is generally preferred. When bent, the frame 20 has been formed. It may be reinforced with plywood strips 110 along the bottom where the ends abut. It defines the interior volume of the suitcase 10. A second piece 114 is assembled with two portions that will form side panels and a connecting portion which will extend across the bottom of the frame 20. A zipper half is sewn around the margin of each portion which will form a side panel. The second piece 114 is then positioned around the frame so that the zippers will mate together. The zippers allow tensioning to be applied across the connecting portion 116 of the second piece 114. The rivets for the bumper legs 112 also provide connection between the second piece 114 and frame 20. Each side panel may be made of a separate piece, but the one-piece construction method is preferred. Sewing a bead 72 into the side panel 24 provides additional protection around the periphery of the suitcase 10 when it is closed. Also, the reinforcing strip 70 which defines the bead 72 provides additional strengthening for the panels.

While particular embodiments of this invention have been shown and described, this invention is not limited to them. Many modifications may be made. Any and all such modifications which fall within the true spirit and scope of the basic underlying principles disclosed and claimed herein are covered, unless limitation is necessary due to the prior art or the spirit of these claims.

I claim:

1. A method for making a suitcase, comprising the steps of:

(a) forming a rigid tubular frame which defines the interior volume of the suitcase, the frame having opposed peripheral edges, each edge defining a side area for the suitcase;

(b) forming an integral piece, which includes two portions, each portion being shaped for covering substantially the side area of one side of the frame, and a third connecting portion, which integrally connects the two shaped portions and which defines a bottom of the suitcase when the suitcase is made;

(c) connecting the piece to the frame with two zippers, one zipper on each edge about substantially the entire periphery of an edge, one half of the zippers being fastened along the margins of the frame and the other half of the zippers being fastened along the shaped portions of the piece, wherein the connecting portion of the piece is also connected to the frame and overlies and covers the zippers on the exterior of the frame to form the bottom.

2. The method of claim 1 wherein the step of forming the frame includes the steps of:

(a) cutting a support member to the desired length, the member having two ends and outwardly extending flanged edges;

(b) holding fabric portions by friction in the flanged edges of the support member;

(c) sewing halves of zippers to the exposed edges of the fabric portions, one zipper half on each edge;

(d) bending the support member, fabric portions, and zipper halves into the desired shape for the frame, so that the ends substantially abut.

3. The method of claim 2, further comprising placing a strip adjacent to the frame in the interior of the suitcase above the abutting ends to reinforce the bottom of the suitcase and to help hold the ends of the support member substantially in abutment.

4. The method of claim 3 further comprising connecting a plurality of bumper legs to the frame through the connecting portion.

* * * * *